US009194090B2

(12) United States Patent
Raml

(10) Patent No.: US 9,194,090 B2
(45) Date of Patent: Nov. 24, 2015

(54) PORTABLE WINDBREAK DEVICE

(71) Applicant: Charles H. Raml, Watertown, SD (US)

(72) Inventor: Charles H. Raml, Watertown, SD (US)

( * ) Notice: Subject to any disclaimer, the term of this patent is extended or adjusted under 35 U.S.C. 154(b) by 0 days.

(21) Appl. No.: 14/190,401

(22) Filed: Feb. 26, 2014

(65) Prior Publication Data

US 2015/0240432 A1 Aug. 27, 2015

(51) Int. Cl.
*E04H 17/16* (2006.01)
*E01F 7/02* (2006.01)

(52) U.S. Cl.
CPC ..... *E01F 7/025* (2013.01)

(58) Field of Classification Search
USPC ..... 33/1, 24, 30, 31, 65.14, 73; 248/188.1, 248/188.8, 519, 527, 677; 135/121, 117, 135/901; 160/135, 351; 256/1, 24, 30, 31, 256/65.14, 73
See application file for complete search history.

(56) References Cited

U.S. PATENT DOCUMENTS

| | | | | | |
|---|---|---|---|---|---|
| 2,784,779 | A | * | 3/1957 | Knipfer et al. | 160/135 |
| 3,592,288 | A | | 7/1971 | Walter | |
| 3,605,851 | A | | 9/1971 | Miles et al. | |
| 3,756,568 | A | * | 9/1973 | Mocny et al. | 256/59 |
| 3,920,221 | A | * | 11/1975 | Berry et al. | 256/59 |
| 3,946,992 | A | * | 3/1976 | Elias | 256/58 |
| 4,878,685 | A | * | 11/1989 | Bahm | 280/304.1 |
| 4,974,864 | A | * | 12/1990 | Giocastro | 280/288.3 |
| 5,240,230 | A | * | 8/1993 | Dougherty | 256/31 |
| 5,402,988 | A | * | 4/1995 | Eisele | 256/24 |
| 5,609,176 | A | * | 3/1997 | Weeks | 135/96 |
| 5,649,396 | A | * | 7/1997 | Carr | 52/174 |
| 5,964,548 | A | * | 10/1999 | Akins et al. | 403/398 |
| 6,053,845 | A | * | 4/2000 | Publicover et al. | 482/35 |
| 6,182,740 | B1 | | 2/2001 | Pfaff | |
| 6,199,833 | B1 | * | 3/2001 | Bilby et al. | 256/24 |
| 6,435,468 | B1 | | 8/2002 | Simchoni | |
| 6,439,344 | B1 | * | 8/2002 | Cole | 182/113 |
| 6,540,209 | B2 | * | 4/2003 | Ross | 256/68 |
| 6,592,094 | B1 | | 7/2003 | Kao | |
| 6,851,661 | B1 | | 2/2005 | Penning | |
| 7,055,806 | B2 | * | 6/2006 | York et al. | 256/28 |
| 7,338,033 | B2 | | 3/2008 | Anson et al. | |
| 7,373,746 | B1 | * | 5/2008 | Pettesch | 40/605 |
| 8,387,955 | B2 | * | 3/2013 | Ptacek et al. | 256/31 |
| 2013/0153843 | A1 | | 6/2013 | Leach | |

* cited by examiner

*Primary Examiner* — Gregory Binda
*Assistant Examiner* — Nahid Amiri

(57) ABSTRACT

A portable windbreak device facilitates lifting and moving of a windbreak by providing rotatable legs which need not be removed from the main panel to move and store the device. The device includes a panel having a top edge, a bottom edge, and a pair of opposed side edges extending between the top edge and the bottom edge. A sleeve is coupled to the panel proximate the bottom edge of the panel. A leg has a pair of outer sections extending from a post. The post is inserted into the sleeve such that the post is rotatable in the sleeve. The post is retained in the sleeve when the panel is lifted.

11 Claims, 5 Drawing Sheets

PORTABLE WINDBREAK DEVICE

BACKGROUND OF THE DISCLOSURE

Field of the Disclosure

The disclosure relates to windbreak devices and more particularly pertains to a new windbreak device for facilitating lifting and moving of a windbreak by providing rotatable legs which need not be removed from the main panel to move and store the device.

SUMMARY OF THE DISCLOSURE

An embodiment of the disclosure meets the needs presented above by generally comprising a panel having a top edge, a bottom edge, and a pair of opposed side edges extending between the top edge and the bottom edge. A sleeve is coupled to the panel proximate the bottom edge of the panel. A leg has a pair of outer sections extending from a post. The post is inserted into the sleeve such that the post is rotatable in the sleeve. The post is retained in the sleeve when the panel is lifted.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
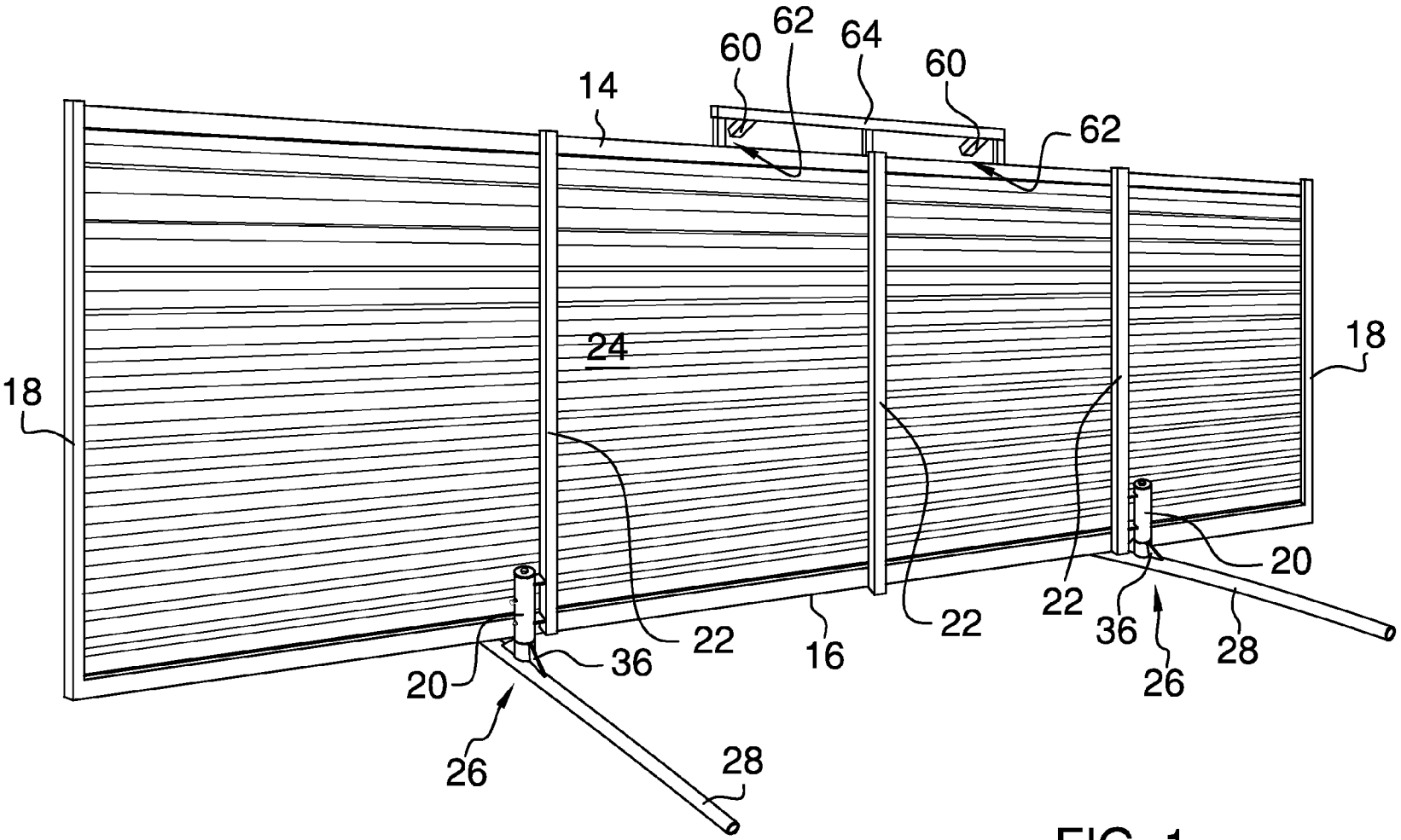
FIG. 1 is a top front side perspective view of a portable windbreak device according to an embodiment of the disclosure.
Figure 2:
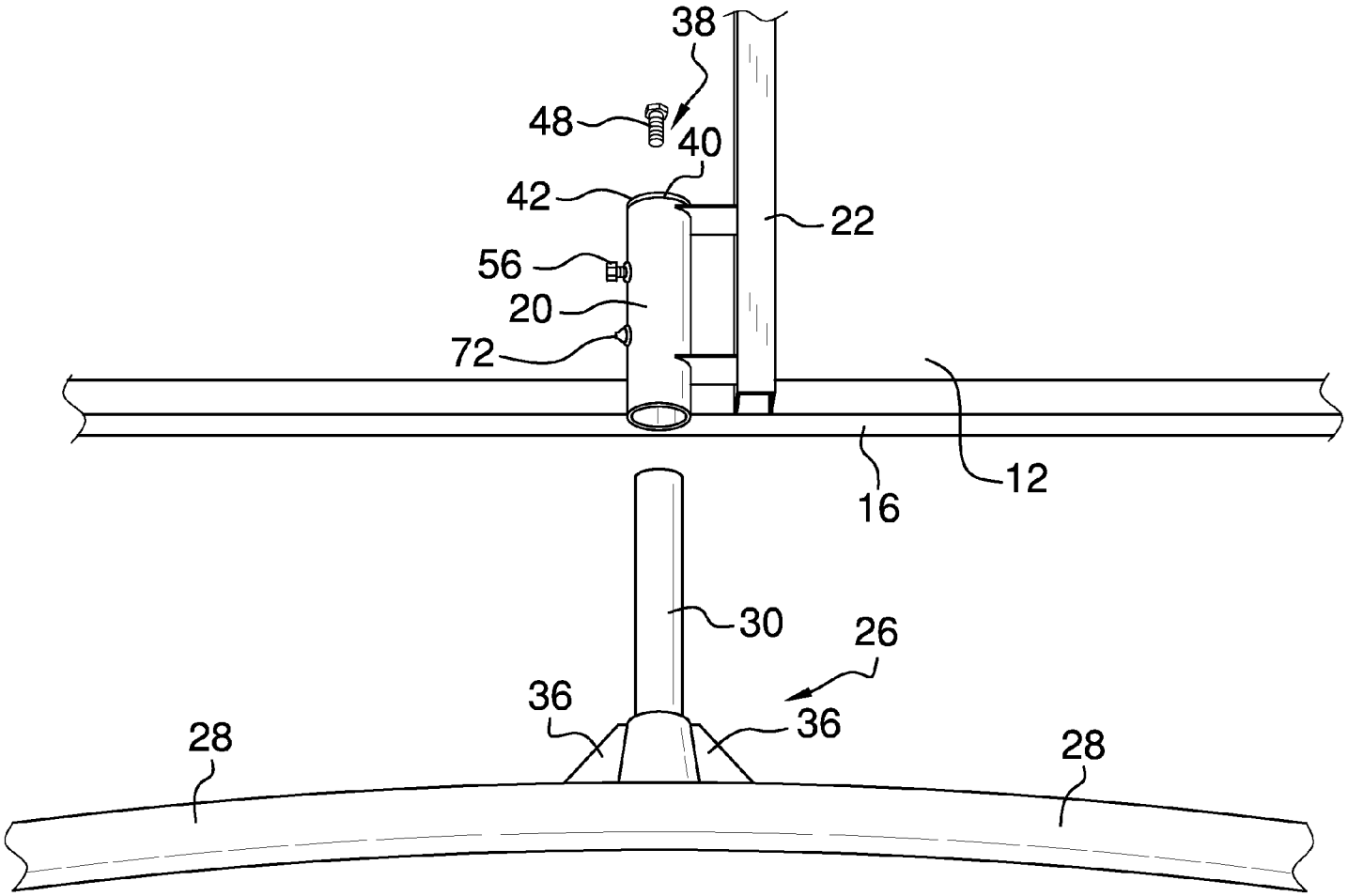
FIG. 2 is a partially exploded view of a leg connection of an embodiment of the disclosure.
Figure 3:
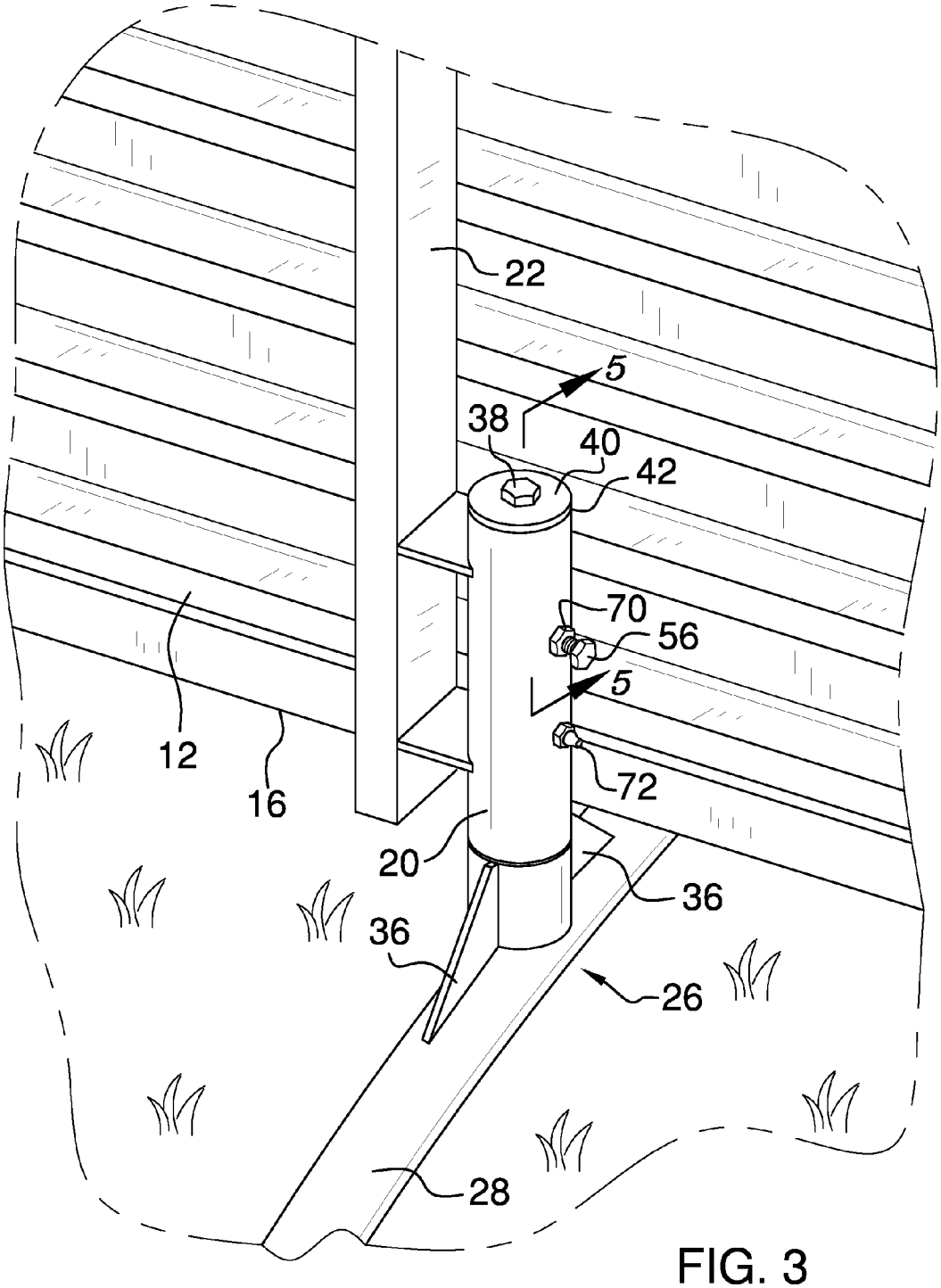
FIG. 3 is a detailed front side perspective view of a leg connection of an embodiment of the disclosure.
Figure 4:
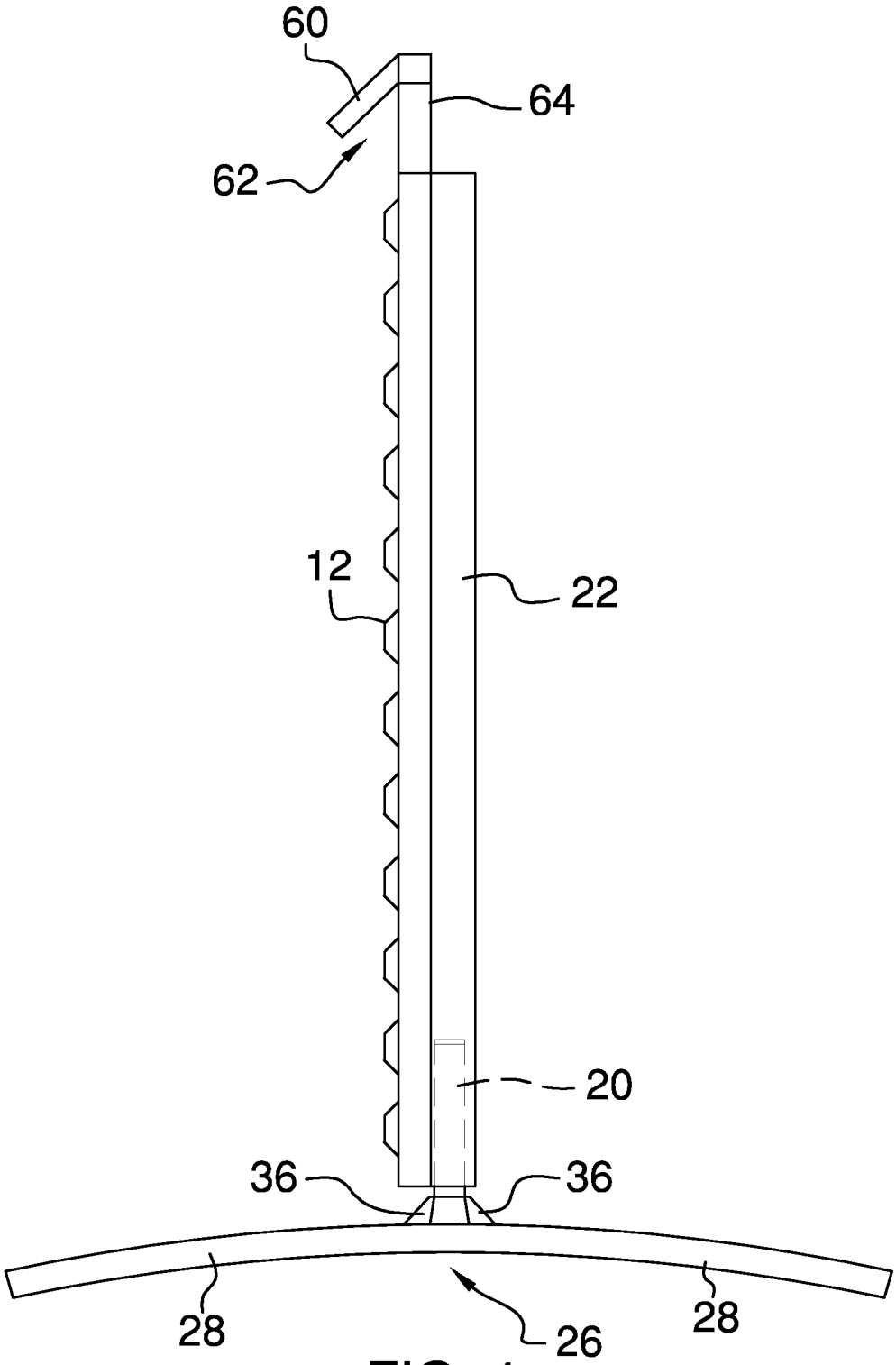
FIG. 4 is a side view of an embodiment of the disclosure.
Figure 5:
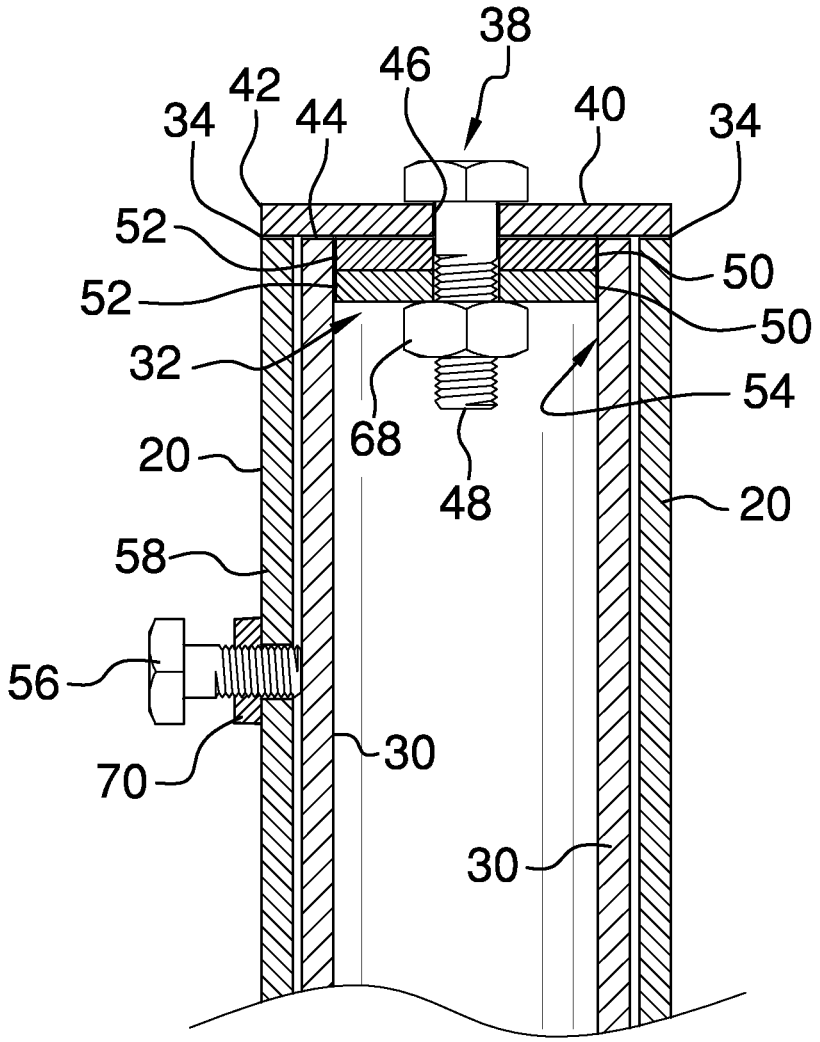
FIG. 5 is a cross-sectional view of an embodiment of the disclosure taken along line 5-5 of FIG. 3.

With reference now to the drawings, and in particular to FIGS. 1 through 5 thereof, a new windbreak device embodying the principles and concepts of an embodiment of the disclosure and generally designated by the reference numeral 10 will be described.

As best illustrated in FIGS. 1 through 5, the portable windbreak device 10 generally comprises a panel 12 having a top edge 14, a bottom edge 16, and a pair of opposed side edges 18 extending between the top edge 14 and the bottom edge 16. Each of a pair of sleeves 20 is coupled to the panel 12. Each sleeve 20 is positioned proximate the bottom edge 16 of the panel 12. A plurality of braces 22 may be coupled to the panel 12 extending between the top edge 14 and the bottom edge 16 on a face of the panel 24. Each sleeve 20 may be coupled to an associated one of the braces 22 such that the sleeve 20 is parallel to both the associated brace 22 and the panel 12. Each sleeve 20 may also be positioned such that the sleeve 20 is coplanar with the associated brace 22. A pair of legs 26 are provided. Each leg 26 has a pair of outer sections 28 extending from a post 30. The post 30 is inserted into and remains positioned in a respective one of the sleeves 20 wherein the post 30 is rotatable in the sleeve 20. The post 30 is coupled to the panel 12, particularly by being coupled into the sleeve 20, such that the post 30 is retained in the sleeve 20 when the panel 12 is lifted. Thus, the legs 26 are prevented from disengaging from the panel 12 due to being embedded in soil, covered by debris, or otherwise stuck to a ground surface upon which the panel 12 has been positioned. Each of the outer sections 28 of each leg 26 extends outwardly away from and downwardly from the post 30 of the leg 26. Each of a plurality of gussets 36 is coupled to and extends between an associated one of the outer sections 28 of each leg 26 and the post 30 of the leg 26.

Each leg 26 may be rotated to be transversely oriented relative to the panel 12 wherein the legs 26 support the panel 12 in a substantially vertical plane. A fastener 38 extends through a top end 34 of the sleeve 20. The fastener 38 engages the post 30 wherein the post 30 is retained in the respective sleeve 20. For each leg 26, an end washer 40 has an outer diameter 42 greater than an inner diameter 44 of the sleeve 20. The end washer 40 further has an inner diameter 46 less than the inner diameter 44 of the sleeve 20 wherein the end washer 40 is positionable on the top end 34 of the sleeve 20. The fastener 38 extends through the end washer 40 wherein the end washer 40 prevents the fastener 38 from passing fully into the sleeve 20. Each post 30 has a respective cavity 32 extending into the top end 34 of the post 30. A shaft 48 of the fastener 38 extends through a spacer 50. The spacer 50 is positioned in the cavity 32 and centers the shaft 48 of the fastener 38 in the sleeve 20. An outer diameter 52 of the spacer 52 is complementary to an inwardly facing surface 54 defining the cavity 32 wherein the spacer 50 is positioned in the cavity 32 and centers the shaft 48 of the fastener 38 within the post 30. The fastener 38 is secured by a nut 68 fastened to the shaft 48.

A respective screw 56 may be coupled to each sleeve 20. The screw 56 is extendable through a sidewall 58 of the sleeve 20 such that the screw 56 frictionally engages the post 30 within the sleeve 20 wherein the screw 56 inhibits rotation of the post 30 within the sleeve 20 when the screw 56 is tightened. The screw 56 may be inserted through a threaded nut 70 coupled securely to the sleeve 20 by a fixed connection such as a weld or the like. A grease fitting 72 is coupled to and extends into the sleeve 20 to facilitate the introduction of a lubricant such as grease into the sleeve 20 to facilitate rotation of the leg 26 within the sleeve 20.

At least one plate 60 may be coupled to the panel 12. The plate 60 is oriented such that the plate 60 extends downwardly relative to the panel 12 and away from the panel 12 defining a hook 62 wherein the plate 60 is configured for lifting the panel 12 when the plate 60 is inserted into a bucket, or similar attachment coupled to a boom arm or other movable mechanism of a vehicle such as a tractor, skidsteer, or the like. The plate 60 may be one of a pair of spaced plates 60. Each of the spaced plates 60 may be coupled to and extend from a mounting bracket 64 coupled to and extending upwardly from the top edge 14 of the panel 12. The spaced plates 60 may be substantially coplanar forming aligned hooks 62 parallel to the panel 12.

In use, the legs 26 are rotatable between storage positions parallel to the panel 12 and a supporting position transverse to the panel 12. The length of the outer sections 28 permits the legs 26 to remain attached to the panel 12 substantially at all times. The respective screw 56 is tightened to hold each leg 26 in a desired position between the parallel and transverse positions relative to the panel 12. The panel 12 may be lifted by engagement of a bucket or similar attachment to a vehicle capable of lifting and moving the panel 12 to a desired location.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A windbreak device comprising:

a panel having a top edge, a bottom edge, and a pair of opposed side edges extending between said top edge and said bottom edge;

a sleeve coupled to said panel, said sleeve being positioned proximate said bottom edge of said panel;

a leg having a pair of outer sections extending from a post, said post being inserted into said sleeve wherein said post is rotatable in said sleeve, said post being coupled to said panel wherein said post is retained in said sleeve when said panel is lifted; and a plate coupled to said panel, said plate being oriented such that said plate extends downwardly relative to said panel and away from said panel defining a hook wherein said plate is configured for lifting said panel when said plate is inserted into a bucket coupled to a vehicle.

2. The device of claim 1, further comprising a fastener extending through a top end of said sleeve, said fastener engaging said post wherein said post is retained in said sleeve.

3. The device of claim 2, further comprising an end washer having an outer diameter greater than a diameter of said sleeve, said end washer having an inner diameter less than said diameter of said sleeve wherein said end washer is positionable on said top end of said sleeve, said fastener extending through said end washer wherein said end washer prevents said fastener from passing fully through said top opening and into said sleeve.

4. The device of claim 3, further comprising a spacer, a shaft of said fastener extending through said spacer, said spacer centering said shaft of said fastener in said sleeve.

5. The device of claim 4, further comprising:

said post having a cavity extending into a top end of said post; and an outer diameter of said spacer being complementary to an inner diameter of said cavity wherein said spacer is positioned in said cavity and centers said shaft of said fastener within said post.

6. The device of claim 1, further comprising said plate being one of a pair of spaced plates.

7. The device of claim 6, further comprising each of said spaced plates being coupled to and extending from a mounting bracket coupled to and extending upwardly from said top edge of said panel.

8. The device of claim 1, further comprising each of said outer sections of said leg extending outwardly away from and downwardly from said post.

9. The device of claim 8, further comprising a plurality of gussets, each said gusset being coupled to and extending between an associated one of said outer sections of said leg and said post.

10. The device of claim 1, further comprising a screw coupled to and being extendable through a sidewall of said sleeve such that said screw frictionally engages said post wherein said screw inhibits rotation of said post within said sleeve when said screw is tightened.

11. A windbreak device comprising:

a panel having a top edge, a bottom edge, and a pair of opposed side edges extending between said top edge and said bottom edge;

a sleeve coupled to said panel, said sleeve being positioned proximate said bottom edge of said panel; and a leg having a pair of outer sections extending from a post, said post being inserted into said sleeve wherein said post is rotatable in said sleeve, said post being coupled to said panel wherein said post is retained in said sleeve when said panel is lifted, each of said outer sections of said leg extending outwardly away from and downwardly from said post, said post having a cavity extending into a top end of said post;

a plurality of gussets, each said gusset being coupled to and extending between an associated one of said outer sections of said leg and said post;

a fastener extending through a top end of said sleeve, said fastener engaging said post wherein said post is retained in said sleeve;

an end washer having an outer diameter greater than a diameter of said sleeve, said end washer having an inner diameter less than said diameter of said sleeve wherein said end washer is positionable on said top end of said sleeve, said fastener extending through said end washer wherein said end washer prevents said fastener from passing fully through said top opening and into said sleeve;

a spacer, a shaft of said fastener extending through said spacer, said spacer centering said shaft of said fastener in said sleeve, an outer diameter of said spacer being complementary to an inner diameter of said cavity wherein said spacer is positioned in said cavity and centers said shaft of said fastener within said post;

a screw coupled to and being extendable through a sidewall of said sleeve such that said screw frictionally engages said post wherein said screw inhibits rotation of said post within said sleeve when said screw is tightened; and a plate coupled to said panel, said plate being oriented such that said plate extends downwardly relative to said panel and away from said panel defining a hook wherein said plate is configured for lifting said panel when said plate is inserted into a bucket coupled to a vehicle, said plate being one of a pair of spaced plates, each of said spaced plates being coupled to and extending from a mounting bracket coupled to and extending upwardly from said top edge of said panel.

* * * * *